United States Patent [19]

Brinker

[11] 4,292,872

[45] Oct. 6, 1981

[54] APPARATUS FOR PERFORATING HOLLOW CYLINDERS

[75] Inventor: Reiner G. Brinker, Mechanicsville, Va.

[73] Assignee: Philip Morris Incorporated, New York, N.Y.

[21] Appl. No.: 96,432

[22] Filed: Nov. 21, 1979

[51] Int. Cl.[3] ..... B26F 1/24

[52] U.S. Cl. ..... 83/866; 83/30; 83/54; 83/440.1; 83/660; 83/926 C; 131/281

[58] Field of Search ..... 83/30, 54, 284, 331, 83/349, 440.1, 660, 866, 926 C; 131/23 R, 170 R

[56] References Cited

U.S. PATENT DOCUMENTS

| | | | |
|---|---|---|---|
| 528,696 | 11/1894 | Sergeant | 83/660 X |
| 1,958,694 | 5/1934 | Chandler | 83/660 |
| 4,020,725 | 5/1977 | Climo | 83/30 X |
| 4,061,148 | 12/1977 | Goslin et al. | 131/170 R X |
| 4,090,826 | 5/1978 | Hinzmann | 131/170 R X |
| 4,140,137 | 2/1979 | Snow | 131/254 X |
| 4,184,619 | 2/1980 | Stewart et al. | 83/660 X |
| 4,193,410 | 3/1980 | Williams et al. | 131/23 R X |

*Primary Examiner*—Frank T. Yost
*Assistant Examiner*—Robert P. Olszewski
*Attorney, Agent, or Firm*—Watson, Leavenworth, Kelton & Taggart

[57] ABSTRACT

Hollow cylinders of relatively rigidized paper are perforated in closely spaced circularly extending, axially spaced rows by perforating adjacent ones of the rows from opposite sides on the cylinders. Apparatus for perforating the cylinders uses a fixed rolling shoe and a rotating drum each of which carry needles to effect perforation. The method and apparatus are especially effective for perforating paper cylinder cigarette mouthpieces.

2 Claims, 6 Drawing Figures

APPARATUS FOR PERFORATING HOLLOW CYLINDERS

BACKGROUND OF THE INVENTION

It is becoming an increasingly widespread practice to perforate the wrappings of cigarettes so as to provide or allow for intake to the cigarette of a dilution air stream during the smoking of the cigarettes. The perforated openings can be formed in various manners and in the cigarette be located either in the tobacco rod or, as is more generally done, perforations can be provided in a cigarette mouthpiece component or in the filter tip of a filtered type cigarette.

U.S. Pat. Nos. 3,701,353 and 4,140,137 each describe apparatus for perforating filter type cigarettes to provide same with dilution apertures in the filter components thereof. Such apparatus is quite satisfactory for the intended purposes inasmuch as it is employed for perforating a single circular row of perforations around a cigarette filter element. Accordingly, only a single perforating means need be employed at one side of a rolling course through which the cigarettes are moved to effect perforation, the perforating means, in the form of needles, being carried in the rolling shoe. On the other hand and where it is desired to perforate a cigarette mouthpiece component which is provided in the form of a hollow relatively rigidized paper cylinder with a plurality of rows of such perforations extending axially spaced along the paper mouthpiece, the apparatus disclosed in the cited patents would not be satisfactory if it were sought to perforate the plural rows by merely providing corresponding plural lines of needles in the rolling shoe member. This is so because the close spacing of the rows if all effected from one side of the cylinder would result in crushing or undersirable shape distortion of the cylinder by the perforating force applied thereto.

SUMMARY OF THE PRESENT INVENTION

The present invention relates to method and apparatus for perforating a hollow cylinder of relatively rigidized paper so as to provide it with a plurality of axially spaced, circumferentially extending rows of perforations, the rows being relatively closely spaced on the cylinder structure. In a particular embodiment, the invention is employed for providing four separate encircling rows of perforations around the mouthpiece section of a filter tipped cigarette. The mouthpiece may be of the type which includes an enclosed length or plug of cellulose acetate filter material, the cellulose acetate plug being recessed a distance inwardly from the cigarette mouth end.

In accordance with the invention, the perforation of the paper cylinder is effected while rotating the paper cylinder about its own axis along a fixed rolling course and needle piercing the cylinder during the course of such rotation along a piercing line of action at one side of the rolling course to perforate one of said rows while concurrently needle piercing the cylinder along a piercing line of action located at the opposite side of the rolling course to perforate an adjacent one of said rows. In this manner, the alternating rows are perforated from opposite sides to avoid applying any undue crushing force to the formed shape of the paper cylinder, the spacing between alternate ones of the rows being such as to ensure that the needle penetrating action occurring at the same side of the rolling course effects the desired penetration without causing any undesirable deflection or permanent shape deformation of the paper cylinder.

Desirably, the needle piercing is effected in such manner that each of the rows of perforations is effected while the paper cylinder is rolling through approximately one complete revolution thereof along the rolling course.

The apparatus for perforating the hollow cylinder includes a rotary drum, a rolling shoe disposed adjacent the drum and having a concave rolling surface which is spacedly juxtaposed with the periphery of the drum so as to define therewith an arcuate section passage of fixed dimension. The arcuate section passage constitutes the rolling course through which the hollow paper cylinder can be advanced in a sideways travel thereof from the entry end of the passage towards the exit end. A plurality of needles with which the perforation of certain of the rows is effected are carried in the rolling surface of the rolling shoe, with the needles being arranged in lines of needles extending in the direction of the rolling advance of the paper cylinder, the length of the line being sufficient to effect the complete perforation of each circular row during approximately one revolution of the paper cylinder along the rolling course. Additional lines of needles can be carried in the rolling shoe and laterally spaced one from each of the others along the passage, such additional lines being employed in connection with the perforation of a paper cylinder article that is intended to be subsequently sectioned into a plurality of separate filter components for use in making a corresponding plurality of cigarettes.

Needles are also carried on the periphery of the rotary drum with the rotation of the rotary drum effecting transport of the paper cylinder along the rolling course and also for perforating certain of the rows of perforation. The needles carried on the periphery of the rotary drum are arranged in lines of circular array with each line being in a plane transverse to the drum axis. The lines of needles carried on the rotary drum are positioned such as to intervene the lines of needles carried in the rolling shoe, i.e., the positioning of the lines of needles on the rolling shoe are staggered axially of the hollow cylinder with respect to the positioning of the lines of needles carried on the periphery of the rotary drum so that the adjacent ones of the rows of projections are produced at opposite sides of the passage.

Means are also provided to feed a continuous stream of hollow paper cylinders to the entry end of the passage between the rotary drum and rolling shoe.

A further feature of the invention provides that both the rolling shoe and the rotary drum comprise an assembly of elements, i.e., rolling shoe plate segments and rotary drum ring segments. Where the plates and rings contact adjacent like elements, the same are provided with needle receiving bores carried in such meeting surfaces. Biasing means are provided in both the rolling shoe and on the rotary drum to urge the respective plates and rings into meeting surface contact to fixedly secure the needles in their respective bores, yet allow at the same time for quick and ready access for purposes of replacing worn or broken needles. By inserting a tool between an adjacent pair of plates or an adjacent pair of rings, the same can be spread against the normally acting biasing force to permit removal of a defective needle and replacement of same. Upon removal of the tool, the biasing force will hold the plates and/or rings in tight face-to-face contact to ensure fixed securement of the needles in the bores.

The invention accordingly comprises the features of construction, combination of elements, arrangement of parts and steps of assembly which will be exemplified in the construction and method herein set forth and the scope of the invention will be indicated in the claims.

BRIEF DESCRIPTION OF THE DRAWING

A fuller understanding of the nature and objects of the invention will be had from the following detailed description taken in conjunction with the accompanying drawings in which.

Throughout the following description, like reference numerals are used to denote like parts in the drawings.

DESCRIPTION OF THE PREFERRED EMBODIMENTS

The present invention relates to method and apparatus for perforating hollow cylindrical bodies and particularly hollow cylinders of relatively rigidized paper structure. While the preferred embodiments to be described herein are employed in connection with perforating plural, circularly extending rows of perforations on a hollow paper cylinder cigarette mouthpiece, it will be understood that the invention has applicability to perforating cylinders of other materials and intended for other uses.

Figure 1:
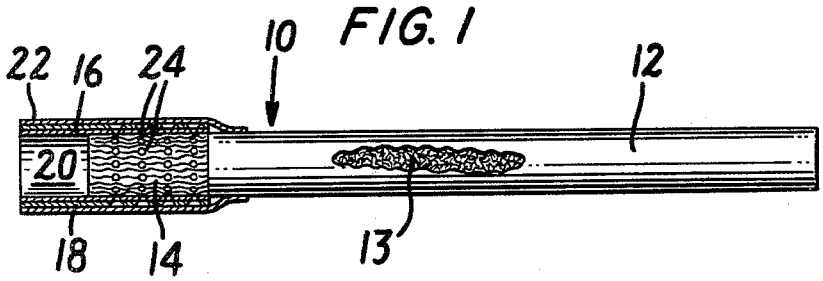
FIG. 1 is a longitudinal elevational view on enlarged scale and partly in section of a cigarette embodying a mouthpiece comprised of a hollow paper cylinder, the mouthpiece being perforated with a number of rows of perforations extending circularly thereof to allow dilution intake of air to the filter wrapped within the mouthpiece.
Figure 3:
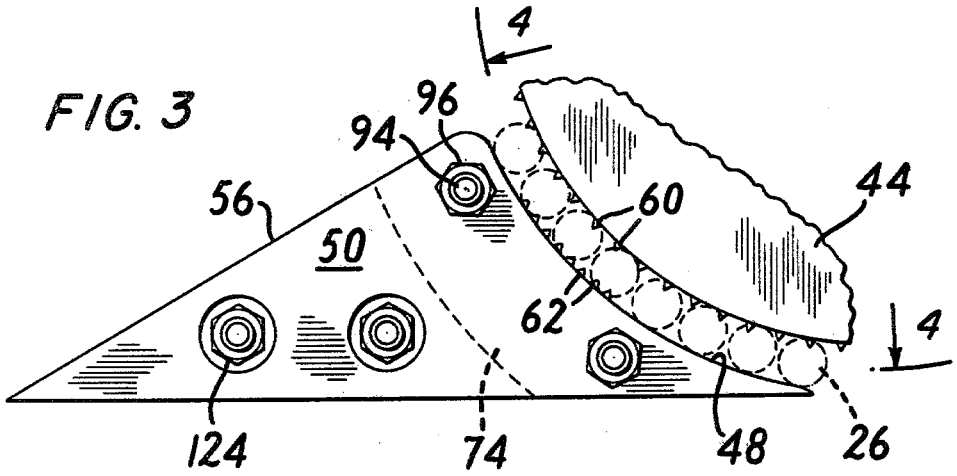
FIG. 3 is a side elevational view of the rolling shoe.
Figure 5:
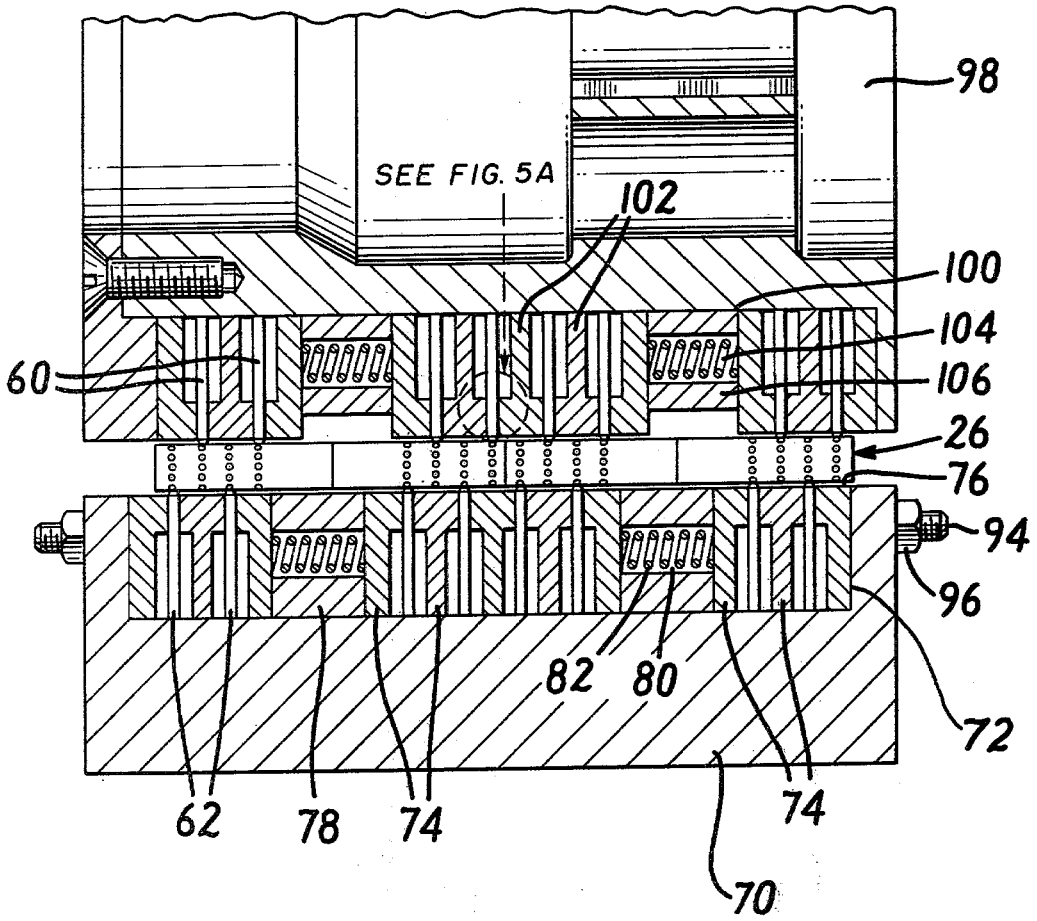
FIG. 5 is a sectional view taken along the line 5—5 in FIG. 3 depicting the manner in which the rolling shoe and rotary drum are comprised of an assembly of plates and rings respectively, to permit ready removal of defective needles from the respective pluralities carried therein.

Referring to FIG. 1, there is shown a cigarette 10 having a tobacco rod component 12 provided as a cylinder of shredded tobacco 13 enclosed in a paper wrapper. A plug 14 of cellulose acetate filter material (part of the overall mouthpiece assembly at the left or smoking end of the cigarette) is disposed at one end of the tobacco cylinder and is encircled by successive paper wrappings 16, 18 which together constitute a paper cylinder of relatively rigidized character and which have an axial length such that they extend a distance beyond the plug 14, leaving a space 20 at the mouth end of the cigarette, those skilled in the art understanding that the mouthpiece assembly is commonly known as a "recessed filter" type. Overlaying the wrapping 18 and employed to join the mouthpiece assembly to the tobacco rod is a wrapping of tipping paper 22 which can be an inherently porous paper. The relatively stiff cylinder provided by the wrappings 16, 18 is perforated with a number (e.g. four) of circularly extending rows of perforations 24 which during smoking of the cigarette allow for intake of dilution air flow to the filter and consequent comingling thereof with the smoke stream drawn from the tobacco rod, the rows being in the depicted cigarette embodiment, all located in the region of the plug 14. In the cigarette manufacturing operation, the filter containing mouthpiece components are manufactured in a continuous stock thereof, the stock being sectioned, e.g., into lengths containing four complete mouthpiece components. These four component lengths are then perforated, sectioned in half to provide two component lengths which in turn are fed to the cigarette combiner units at which tobacco rods are joined to the two component lengths to make two cigarettes, the two cigarettes thereafter being sectioned to separate them. A four mouthpiece component length 26 is shown in FIG. 5 as it is being perforated in the apparatus of the present invention.

Figure 2:
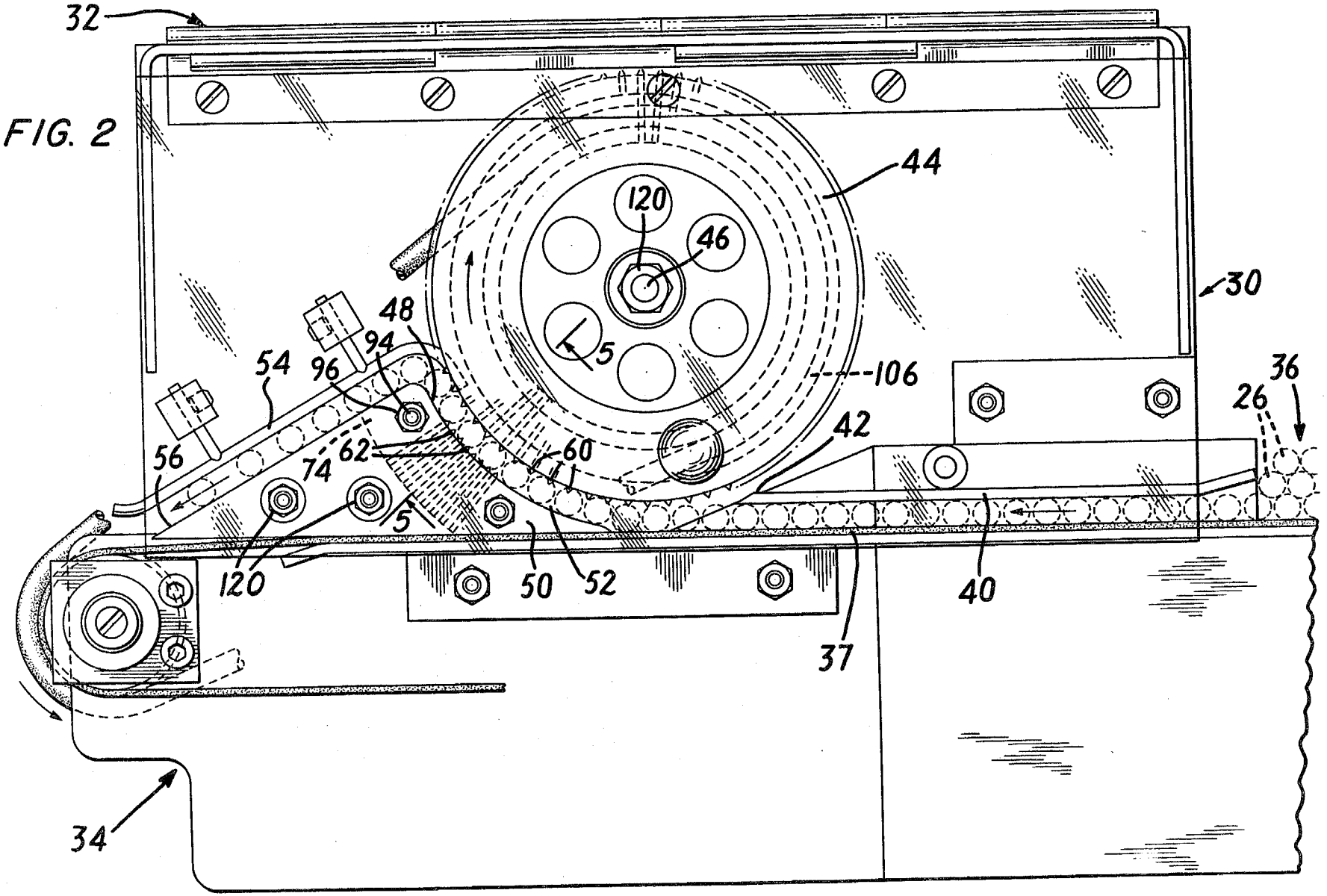
FIG. 2 is a side elevational view of apparatus for perforating a hollow paper cylinder structure in accordance with the present invention, there being shown means to feed a continuous stream of such paper cylinders from a stock thereof to the entry of the passage defined between the rolling shoe and periphery of the rotary drum.

As seen particularly in FIG. 2, the apparatus 30 of the invention is of compact character, occupying, for example, about only 2×2 feet of space and is readily integrated into the cigarette manufacturing operation, the apparatus being advantageously located at the point where a continuous filter component stock is being produced. The apparatus can be housed for safety in a transparent enclosure shown generally at 32, the enclosure extending downwardly around the operating devices to joinder with the apparatus support frame depicted generally at 34, the enclosure comprising a member of hinged walls which can be swung to give clearance for servicing the apparatus and removing the rotary drum and rolling shoe units. A conveyor 37 travels from right to left to deliver a succession of four mouthpiece component lengths of mouthpiece stock in a sideways travel thereof from a suitable supply 36 toward the perforating unit. In travelling toward the perforating unit, the lengths 26 pass under and are guided in singlewise succession movement by a guide 40, the guide terminating as at 42 where the lengths start to pass under ratary drum 44. Rotary drum 44 rotates about fixed axis 46 and its periphery defines with the concaves arcuate rolling surface 48 of fixed rolling shoe 50, a passage 52 of fixed dimension (substantially that of the diameter of a length 26) through which the successive lengths travel to effect perforation of same. The rotational movement of the periphery of the drum serves to transport the lengths 26 from the conveyor 36 to and through passage 52. The succession of lengths travel through passage 52 and up over the top of the rolling shoe, passing under and being controlled in their sideways travel by guide rods 54 with the perforated lengths passing down the back face 56 of the rolling shoe to collection for further use in the cigarette making operation.

Figure 4:
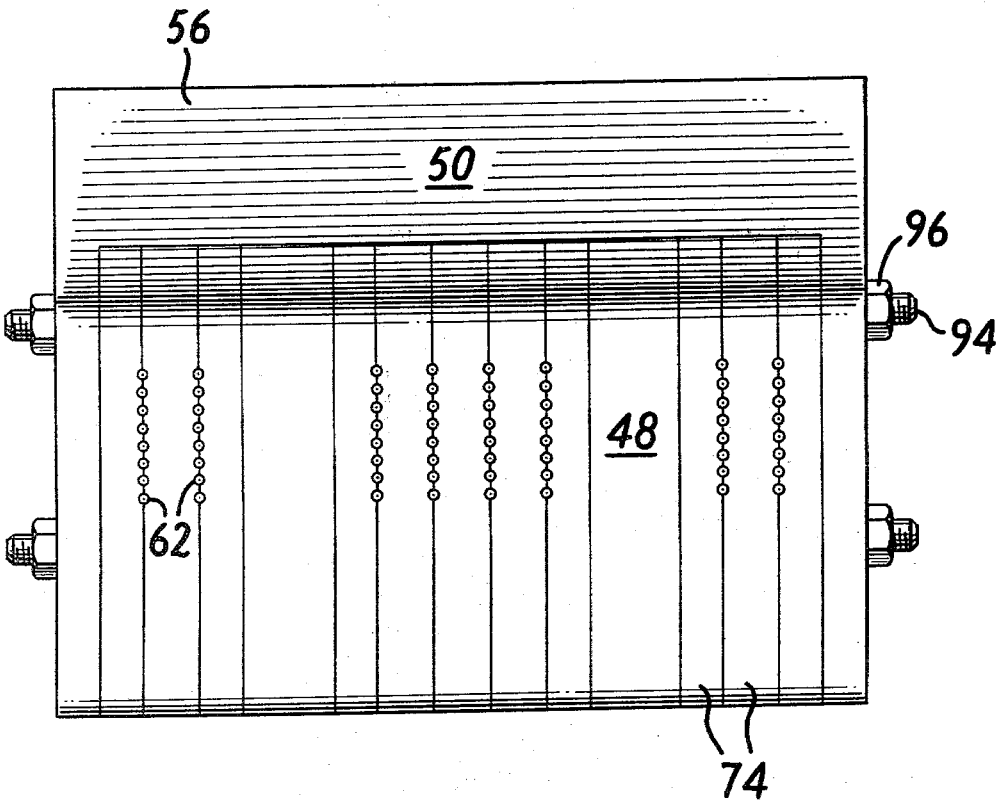
FIG. 4 is a view of the rolling shoe as taken along the line 4—4 in FIG. 3 and showing the array of needles carried in the rolling surface of the shoe and the expanse which the needles occupy thereon in connection with the perforation of an elongated plural segment mouthpiece component that is intended to be sectioned into four individual mouthpiece units.

Rotary drum 44 is provided at its periphery with a plurality of radially extending needles 60 used in conjunction with a further plurality of needles 62 carried in the rolling shoe rolling surface to perforate the lengths 26. The needles 60 extend in circular lines around the drum with there being provided a specified number of such lines spaced axially of the drum in accordance with the numbers of circular rows of perforations to be formed in the lengths 26. Similarly, the needles 62 carried in the rolling shoe extend in lines thereof in the direction of travel of the lengths in passage 52, the lines being laterally spaced of the passage and also provided in numbers dependent on the numbers of rows of perforations to be formed in the lengths 26. In an embodiment for perforating the lengths 26 as seen in FIG. 5, i.e., perforating 16 total rows in the lengths in correspondence to the four rows required in each mouthpiece into which the length is ultimately sectioned, 16 total lines of needles are provided, 8 in the rolling shoe and 8 on the rotary drum. In the depicted embodiment, the rotary drum has 60 circularly spaced needles in each of the 8 axially spaced lines of needles 60 (not all of which are illustrated as being unnecessary for properly understanding the manner in which the needles 60 are mounted in the drum), and as can be seen in FIG. 4, the rolling shoe 50 carries 8 needles 62 in each line with there being 8 lines of needles.

In perforating each of the respective individual filter components of which the lengths 26 are comprised, and inasmuch as the circular rows of perforations formed therein are very closely spaced axially, if the perforations were formed by effecting perforation action at the same relative circular location on the paper cylinders, the force inherent in producing the perforations with needle perforating means could result in structurally distorting or crushing the paper cylinder. Accordingly, the respective successively axially spaced circular rows of perforations in each mouthpiece element are formed by perforating adjacent ones of the rows of perforations at opposite sides of the passage. In other words, the needles 60 on the rotary drum are arranged in lines of needles which intervene the lines of needles in the rolling shoe. By thus positioning the lines of needles in the rotary drum 44 such that they intervene the lines of needles in the rolling shoe 50, there is avoided the problem of distorting or otherwise altering the cylindrical configuration of the paper cylinder while at the same time complete and proper perforation action can be carried out so as to provide openings 24 in the mouthpiece for the ultimate intended purpose of their serving as apertures for the intake of dilution air through the inherently porour tipping paper overwrap 22 (FIG. 1).

Figure 5A:
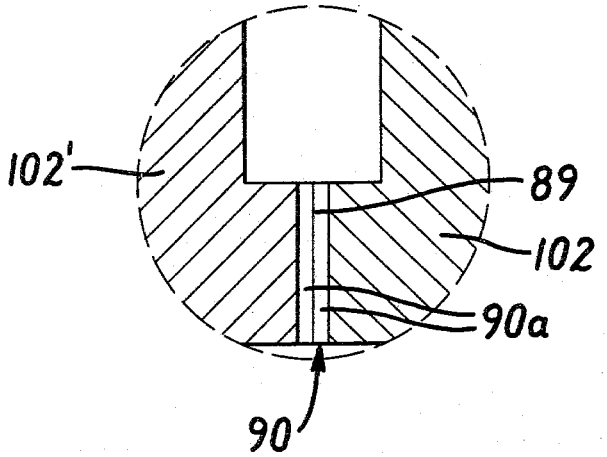
FIG. 5*a* is an enlarged view of the segment of FIG. 5 contained in the dashed line circle of such Figure.

As an adjunct and further advantage of the present invention, and particularly since the perforating needles 60, 62 are from time to time susceptible to wearing, breaking, etc., both the rotary drum 44 and the rolling shoe 50 are constructed such as to allow for convenient and rapid amelioration of the damage to any one or group of needles in either component. For this purpose, the rolling shoe 50 is made up of a base portion 70 which is slotted as at 72 so as to provide a receptive space in the shoe for a plurality of side-by-side arranged plate segments 74. The plate segments 74 each have a common edge as at 76 which define with the edges of like plates the rolling surface 48 of the rolling shoe, certain groupings of the plates being intervened by spacers 78. Disposed within the spacers 78 and carried in bores 80 therein are compression springs 82 which maintain biasing force on the groups of plates. As can be seen in FIG. 5*a*, the effect of the compression springs is to force the meeting faces or side surfaces 89 of the respective plates into firm contact so that the needles 62 carried in bores 90 formed in the side meeting faces of the plates can be tightly retained in fixed position within the rolling shoe. At the same time, if it is necessary to remove a damaged needle at any particular location, a suitable tool can be inserted or forced between adjacent plates where they meet to spread them against the force of the biasing spring and allow for access and removal of the damaged needle and replacement of same. When the tool or prising means used for such purpose is removed, the biasing springs will of course urge the plates back into tight face to face contact and hence securely retain the inserted needles within their bores. Assembly of the plates as a unitary structure is further maintained by means of an elongated stud member 94 and suitable nuts 96 which are used to tighten the assembly of plates within the shoe base 70. Similarly and in like fashion, the rotary drum 44 which has a core body part 98 is slotted at its periphery with an annular recess 100 in which is received a number of ring members 102 which are maintained in side face-to-side face contact by means of biasing means in the form of compression springs 104 carried in spacer members 106. It will be noted in connection with the spacer members 106 that they are recessed somewhat inwardly of the periphery of the rotary drum to allow clearance space for the rotation of the drum past the upper forward end of guide member 54 (FIG. 2). Since the ring members are held in tight contact by the biasing force of the springs 104, the same principle of needle replacement applies thereto so that by inserting a tool between adjacent ones of the rings, the same can be spready apart to effect removal of defective needles.

FIG. 5*a* shows in enlarged detail the constructional principle involved in holding the needles tightly wherein the adjacent ring members 102 and 102' have in their meeting faces half bore configurations 90*a* which define a cylindrical bore 90 for reception of a circular sectioned needle member 60.

With regard to the manner in which the perforation of the hollow paper cylinder is effected, reference is made to FIG. 2. It will be noted that the lengths 26 of mouthpiece stock are advanced by means of the conveyor 37 from the stock location to the end of the guide 42 from whence the paper cylinders are propelled by the rotation of rotary drum 44 into the entry end of the passage 52. Generally the advance of the respective and successive sections 26 from the location at the end of the guide 42 into and through the entrance of passage 52 is in the form of a sideways sliding of the sections 26 with little if any but occasional perforation thereof being effected by the needle 60 carried on the rotary drum. However, when the sections 26 reach the first of the needles 62 in the respective lines thereof of rolling shoe 50, the continued rotative movement of the rotary drum, and especially since the needles thereof contact the hollow cylindrical member, causes rotation of the sections 26 about their own axis and rotative continued movement past all of the needles in the rolling shoe. In consequence of this rotation of the sections 26 about their own axis during their travel through passage 52, the needles 60 and 62 are both caused to penetrate and perforate the hollow paper cylinder. The travel of the section 62 from the first to the last needles in each line of needles in the rolling shoe involves rotation of approximately one complete revolution of the hollow paper cylinders producing in the sections 26 complete encircling rows of perforations. With respect to those rows of perforations which are produced by the needles in the rolling shoe 8 thereof are effected. On the other hand, due to the higher line speed of the periphery of the rotary drum and the greater number of needles at the periphery thereof in each line of needles which encircle the drum, it has been found that about 10 perforations are formed in each row produced by such needles. Thus it will be seen that adjacent ones of the rows of perforations formed in the paper cylinders are formed at opposite sides of the passage 52 so that the radial forces applied by the needle tips as they enter the paper cylinders do not cause any undue deflection in the paper cylinders as would produce distortion or crushing of same.

A further and particular advantage of the present invention results from the ability to minimize the down time of the perforation apparatus when it becomes necessary to replace needles. A spare rotary drum 44 and rolling shoe 50 can be maintained at the apparatus and if it becomes necessary to replace needles in the operating unit, nut 120 can be removed and the drum slid from its mounting shaft to be replaced with the spare. Similarly and since the rolling shoe is mounted on two slideways 124, the shoe readily can be removed and replaced with a spare.

While there is before disclosed only certain embodiments of the present invention, it will be appreciated that certain variations and modifications therein can be produced without departing from the scope of the inventive concept disclosed.

What is claimed is:

1. Apparatus for perforating a hollow cylinder of relatively rigidized paper with a plurality of axially spaced circumferentially extending rows of perforations, said apparatus comprising a rotary drum, a rolling shoe disposed adjacent said drum and having a concave rolling surface spacedly juxtaposed with the periphery of said drum to define therewith an arcuate sectional passage of fixed dimension through which a hollow paper cylinder can be advanced in a sideways travel thereof, from an entry end of said passage toward an exit end of said passage, first needle perforating means comprising a plurality of needles carried in the rolling surface of said rolling shoe, and second needle perforating means comprising a plurality of needles carried on the periphery of said rolling drum, rotation of said rotary drum effecting rolling of the paper cylinder along said rolling surface and perforation thereof by both said needle perforating means, the positioning of the first needle perforating means being staggered axially of the hollow cylinder with respect to the positioning of the second perforating means whereby the perforations formed in adjacent ones of the rows of perforations are produced at opposite sides of said passage, said rolling shoe comprising an assembly of side-by-side arranged plates each having an edge surface alignable with like surfaces of the other plates to define the shoe rolling surface, each needle of the first needle plurality being received in a bore carried in the meeting surfaces of adjacent pairs of said plates, and biasing means urging each plate into side face-to-face contact with an adjacent plate for fixedly securing the needles in their respective bores.

2. Apparatus for perforating a hollow cylinder of relatively rigidized paper with a plurality of axially spaced circumferentially extending rows of perforations, said apparatus comprising a rotary drum, a rolling shoe disposed adjacent said drum and having a concave rolling surface spacedly juxtaposed with the periphery of said drum to define therewith an arcuate sectional passage of fixed dimension through which a hollow paper cylinder can be advanced in a sideways travel thereof, from an entry end of said passage toward an exit end of said passage, first needle perforating means comprising a plurality of needles carried in the rolling surface of said rolling shoe, and second needle perforating means comprising a plurality of needles carried on the periphery of said rolling drum, rotation of said rotary drum effecting rolling of the paper cylinder along said rolling surface and perforation thereof by both said needle perforating means, the positioning of the first needle perforating means being staggered axially of the hollow cylinder with respect to the positioning of the second perforating means whereby the perforations formed in adjacent ones of the rows of perforations are produced at opposite sides of said passage, said rotary drum comprising an assembly of encircling axially arranged rings, each needle of the second needle plurality being received in a bore carried in the side-face meeting surfaces of adjacent pairs of rings, and biasing means urging each ring into meeting side face-to-side face contact with an adjacent ring for fixedly securing the needles in their respective bores.

* * * * *